US008791381B1

(12) United States Patent
Donnelly

(10) Patent No.: US 8,791,381 B1
(45) Date of Patent: Jul. 29, 2014

(54) SAFETY HORN ACTUATOR FOR MOTORCYCLES AND OTHER HANDLEBAR OPERATED VEHICLES

(76) Inventor: Lewis J. Donnelly, Washingtonville, NY (US)

( * ) Notice: Subject to any disclaimer, the term of this patent is extended or adjusted under 35 U.S.C. 154(b) by 305 days.

(21) Appl. No.: 13/374,738

(22) Filed: Jan. 10, 2012

(51) Int. Cl.
*H01H 9/00* (2006.01)
*G05G 11/00* (2006.01)

(52) U.S. Cl.
USPC ..... 200/61.54; 74/484 H; 200/512; 200/505; 200/245

(58) Field of Classification Search
USPC ..... 200/61.41, 61.44, 508, 512, 200/61.54–61.57; 74/488, 484 H; 280/219, 280/315; 439/638, 639; 180/315
See application file for complete search history.

(56) References Cited

U.S. PATENT DOCUMENTS 2,943,164 A 6/1960 Kniffin, Jr.
2,946,869 A 7/1960 Parks et al.
3,476,897 A 11/1969 DeVincent
3,876,844 A 4/1975 Scherenberg
4,003,190 A * 1/1977 Braun et al. ..... 56/10.5
4,742,192 A 5/1988 Levine et al.
4,825,548 A * 5/1989 Driggers ..... 30/276
5,708,244 A 1/1998 Conti
6,600,826 B1 * 7/2003 Xavier ..... 381/384

* cited by examiner

*Primary Examiner* — Renee S Luebke
*Assistant Examiner* — Harshad Patel
(74) *Attorney, Agent, or Firm* — Sandra M. Kotin

(57) ABSTRACT

A safety hand grip for handlebar operated vehicles utilizes an elongate pressure switch in the form of an elongated strip embedded longitudinally within the wall of the resilient hand grip to actuate the horn. A raised area extending substantially the length of the grip and integral with the wall is situated directly over the switch and serves to locate the elongate switch and to concentrate the force applied by the fingers of the operator and transmit that force directly to the elongate switch. The grip can be rotated so the raised portion is positioned under the operator's fingers according to the gripping preference. Dual sided connectors attached to leads from the elongate switch and interposed between the connectors from the horn and battery and the connectors from the console button present on the vehicle enable the horn to be actuated by both the switch and the button.

1 Claim, 2 Drawing Sheets

SAFETY HORN ACTUATOR FOR MOTORCYCLES AND OTHER HANDLEBAR OPERATED VEHICLES

FIELD OF THE INVENTION

The instant invention relates to a horn actuator built into the resilient hand grip of a handlebar operated motor vehicle.

BACKGROUND OF THE INVENTION

All motorized vehicles that have access to roadways must be equipped with a horn so that others can be warned when a dangerous situation is impending. Those vehicles that are driven using handlebars (motorcycles, snowmobiles, motor scooters, and other handlebar operated vehicles) usually have the horn actuator on a console adjacent to one of the handlebars, usually the left handlebar. To actuate the horn, the driver must take his eyes off the road to locate the correct button on the console and remove his or her hand from the handlebar to press that button, the horn actuator. Handlebar operated vehicles are fully open to the elements and offer no protection to the driver. Additionally, these vehicles travel at considerable speeds. Therefore, any time a driver must change the grip or remove the hand from the handlebar concentration is altered and the driver's eye is not on the road ahead. These actions place the driver in a very unsafe situation. The danger is compounded when something happens that requires the horn to be sounded and at the same time the driver must react quickly, often to save his or her life, while maintaining balance and control of the vehicle.

There have been horn actuators built into the steering wheels of automobiles that enable the driver to press or squeeze the wheel at any place around the circumference of the wheel to sound the horn. See U.S. Pat. Nos. 2,943,164; 2,946,869; 3,476,897; 3,876,844; and 4,742,192. These patents all accomplish the same end using somewhat similar technologies.

There has only been one attempt to solve this problem for riders of motorcycles and no references have been found for use with other motorized handlebar operated vehicles. Conti, in U.S. Pat. No. 5,708,244 teaches the use of a ribbon switch placed into a 360° recess in the rubber hand grip of the left handlebar. The recess is located in a narrow area around the inside end of the hand grip. Leads from the ribbon switch are connected to the horn and the battery respectively. Any pressure or squeezing at the inside end of the handlebar grip, directly over the switch, will actuate the horn. However, though the switch is around the inside end of the grip, a motorcyclist usually grips the handlebar along the central portion of the grip. This means that the hand must be moved to the innermost end of the grip to actuate the switch as taught by Conti. Certainly moving the hand along the grip is safer then moving it off the grip to press a button on the console, but any movement of the hand at a critical time, even to the inside edge of the hand grip, can disturb the driver's concentration when split second action may be needed to avert an accident.

There is a need for a means to actuate the horn of a motorcycle or other handlebar operated vehicle whereby the driver does not have to take his or her eyes off the road or move his or her hand from its normal operating position on the grip in order to actuate the horn.

BRIEF SUMMARY OF THE INVENTION

The present invention provides a switch built longitudinally into the resilient grip of a motorcycle or other handlebar operated vehicle that enables the driver to actuate the horn by simply pressing or squeezing a raised locator present along the full length of the resilient grip. The longitudinally oriented locator lies directly over the switch so the driver does not have to move his or her hand from its normal operating position.

It is an object of the present invention to provide a means to actuate the horn of a handlebar-operated vehicle that does not require the driver to move his or her hand from its normal operating position.

It is also an object of the present invention to provide a means to actuate the horn of a handlebar-operated vehicle that does not require the driver to take his or her eyes off the road ahead.

It is a further object of the present invention to provide a means to actuate the horn of a handlebar-operated vehicle that is built into the resilient grip positioned over the end of the handlebar.

It is another object of the present invention to provide a means to actuate the horn of a handlebar-operated vehicle by squeezing a raised portion of the handlebar grip, a motion often done as a reflex action when a serious situation arises.

It is also an object of the present invention to have the raised area along the length of the handlebar grip indicating the location of the horn actuator within the grip.

Another object of the present invention is to have the raised area serve to concentrate the force exerted directly to the switch to actuate the horn.

A further object of the present invention is to provide a hand grip for use on a handlebar operated vehicle that can be rotated to provide the most efficient orientation for actuation of the horn according to the gripping preference of the user.

It is a still further object of the present invention to provide a replacement grip for a handlebar operated vehicle that includes a horn actuator that can be easily connected to the existing horn and that will still permit the horn to be actuated in the usual manner from the console.

It is another object of the present invention to provide a horn actuator that can be purchased as a replacement kit and easily installed by the vehicle's owner.

The invention is a safety hand grip which contains a horn actuator for use with handlebar operated vehicles. The safety handgrip comprises a resilient cylinder dimensioned to be accepted over the end portion of a rigid handlebar, an elongate switch in the form of a strip substantially the length of the cylinder and being longitudinally embedded within the wall of the cylinder, means to locate the switch for ease of actuation and to concentrate force to aid actuation, and means to connect the switch to a horn and a battery. Force exerted at any point along the locating and concentrating means directly over the switch will actuate the horn without the operator having to remove his or her hand from its normal operating position on the hand grip.

The invention is also a safety hand grip containing a horn actuator for use with handlebar operated vehicles that comprises a resilient cylinder dimensioned to be accepted over the end portion of a rigid handlebar and being sufficiently rotatable on the handlebar to enable rotation of the hand grip according to the gripping preference of the operator, an elongate switch in the form of a strip substantially the length of the cylinder and disposed longitudinally within the wall of said cylinder, and a switch locator in the form of a longitudinal raised portion integral with the outside of the wall of the cylinder directly over the elongate switch so that a force applied to the raised portion by the fingers of the operator is concentrated over the elongate switch to cause actuation of the horn. There are also two leads, each connected at one end to the elongate switch and the other end, one to a horn and the other to a battery. When the operator exerts the force on the raised portion with his or her fingers without having to move his or her hand from its normal operating position the horn is actuated.

Also disclosed is a method of installing a safety hand grip containing a first horn actuator on a handlebar operated vehicle having original hand grips on each end of the rigid handlebar, a horn, a battery, and a second horn actuator disposed on a console adjacent the handlebar. The method comprises the steps of obtaining the safety hand grip containing the first horn actuator which comprises a resilient cylinder dimensioned to be accepted over the end portion of the rigid handlebar, an elongate switch in the form of a strip substantially the length of the cylinder and embedded longitudinally within the wall of the cylinder, a switch locator in the form of a longitudinal raised portion integral with the outside wall of the cylinder, the raised portion being substantially the length of the cylinder and disposed directly over said elongate switch to concentrate a force exerted by the fingers of the operator on the elongate switch, and two leads, each connected at one end to the elongate switch and the other end to an electrical connector, each of the electrical connectors being dual sided to accept two connectors. The cylinder is sufficiently rotatable on the handlebar to enable the operator to rotate the cylinder so that the raised portion is positioned under the operator's fingers to accommodate the operator's gripping preference and so the elongate switch is always positioned for actuation of the horn by the exertion of force from the fingers of the operator on the raised portion. Other steps include removing the original hand grip from one end of the rigid handlebar, replacing the original hand grip with the safety hand grip on the end of the rigid the handlebar, and rotating the safety hand grip so the raised portion is positioned according to the gripping preference of the operator. The method also includes opening the console, disconnecting horn and battery connectors from connectors from the second horn actuator, interposing the dual sided connectors from the elongate switch between the connectors from the horn and battery and the connectors from the second actuator, and closing the console. The horn can be actuated by exerting a force on the raised portion and also by using the second horn actuator on the console.

Other features and advantages of the invention will be seen from the following description and drawings.

DETAILED DESCRIPTION OF THE INVENTION

Figure 1:
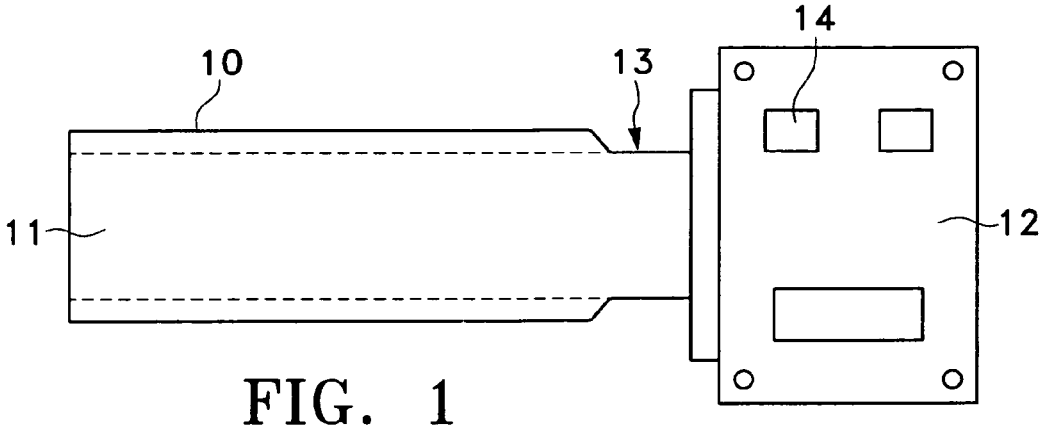
FIG. 1 (PRIOR ART)
FIG. 1 is a plan view of the handlebar, grip and console of a motorcycle (prior art)

Motorcycles and other handlebar operated motorized vehicles may have resilient handgrips 10 positioned over the ends 11 of the handlebars and a console unit 12 adjacent to the inside area of the handlebar 13. The console 12 usually contains several buttons, i.e., an actuator 14 for the horn, as well as for the turn signal indicator and the low beam/high beam adjustments for the headlights. An illustration of the prior art can be seen in FIG. 1. The hand grip 10 may contain ridges, indentations or other protrusions for positioning the fingers and for better hold or grasp (not illustrated). It may be made of rubber or other molded resilient polymeric material.

Figure 4:
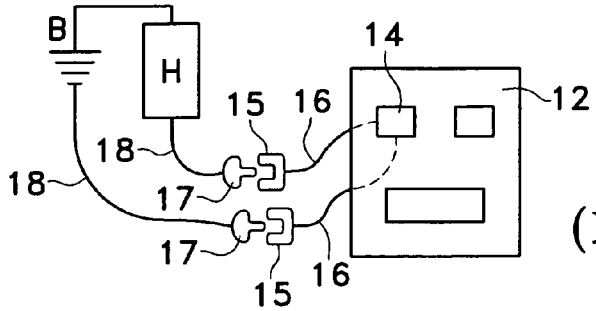
FIG. 4 (PRIOR ART)
FIG. 4 is a schematic view of the connectors from the horn and battery connected to the console actuator (prior art)

There may be leads 16 within the console 12 extending from the horn actuator 14 and terminating with female connectors 15 which may be attached to male connectors 17 from leads 18 to the battery (B) and horn (H) so the horn may be sounded when the horn actuator 14 is pressed. These may be seen in FIG. 4.

The present invention may be a replacement resilient hand grip 20 that may also fit over the end 11 of the handlebar. An actuation switch 22 may be built into the hand grip 20 so that the driver may actuate the horn without moving his or her hand from its normal operating position. The hand grip 20 of the present invention may be sold with the vehicle or may be purchased separately to replace one of the two hand grips present on the vehicle when purchased. The hand grip 20 of the present invention may represent a safer means to actuate the horn then has been shown in the prior art. Since the hand grip 20 of the present invention does not necessitate the operator to take his or her eyes off the road to locate the horn actuator or to move his or her hand from its normal operating position, the driver can concentrate on the situation at hand and react accordingly. Any time a driver is required to adjust his or her grip on the handlebars or take his or her eyes off the road the driver is in an unsafe situation. Additionally, in times requiring immediate action, a squeezing of the grip may be an automatic reflex action which, with the present invention, would result in the actuation of the horn.

Figure 2:
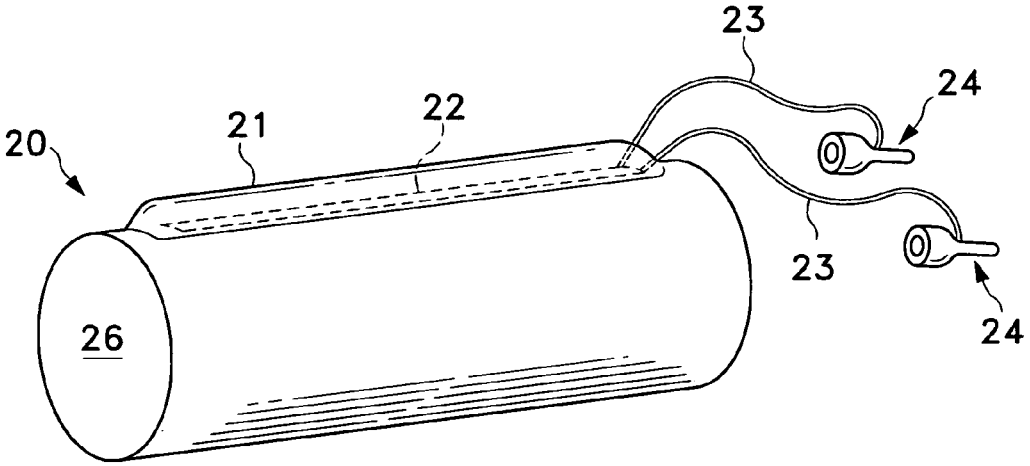
FIG. 2 is perspective view of the grip of the present invention.
Figure 3:
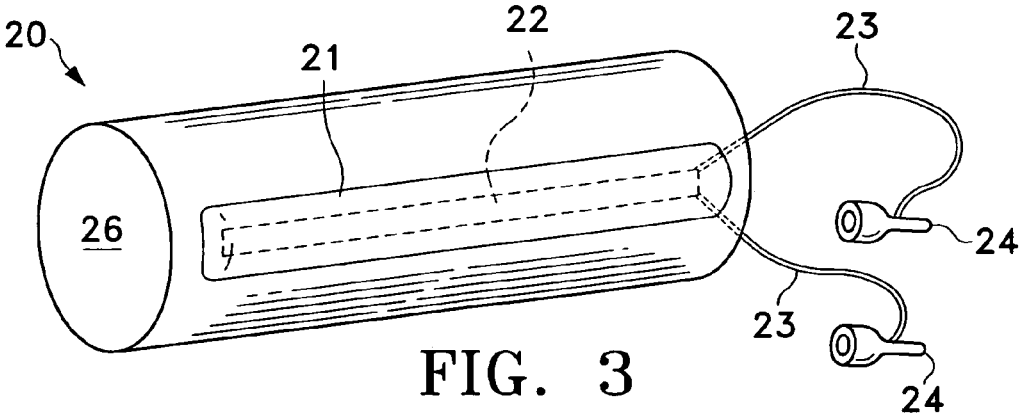
FIG. 3 is a perspective view of the grip of FIG. 2 rotated 90°.

The hand grip 20 of the present invention may be in the form of a cylinder that may be closed at one end 26. The cylinder may be dimensioned to fit tightly over one end of the handlebar 11. Built into the wall of the grip 20 may be a pressure activated momentary elongate switch 22. The elongate switch 22 may be longitudinally embedded within the wall of the hand grip 20 and may extend substantially the full length of the cylinder. Since the elongate switch 22 may be pressure actuated, its location within the grip must be known to the operator and easily locatable for optimum performance. There may be a raised portion 21 integral with the outside wall of the hand grip 20 and running longitudinally for substantially the full length of the hand grip 20. See FIGS. 2 and 3. This raised portion 21 may be situated directly over the elongate switch 22 and may serve two functions. First, it may serve as the locator so the user may know exactly where the elongate switch 22 lies within the hand grip 20 and second, the raised portion 21 may concentrate the force exerted by the fingers of the operator and transfer that force directly onto the elongate switch 22.

Without the raised portion 21, the force exerted by the fingers on the wall of the grip 20 would be distributed over the entire area covered by the fingers. This may not provide sufficient force on the elongate switch 22 to actuate the horn. When the force is applied specifically to the raised portion 21 all of the force is concentrated over a much smaller area which transfers the entirety of the force to the elongate switch 22. Therefore, to actuate the horn, the operator need only squeeze the fingers directly on the raised portion 21.

The hand grip 20 of the present invention may be made of rubber or any resilient polymeric material. It may be manufactured by a molding process and the elongate switch 22 may be inserted into the hand grip 20 during that molding process. Using this method of manufacture, the elongate switch 22 may be permanently imbedded in the wall of the grip 20 and may remain in a specific orientation so that it cannot be dislodged. The raised portion 21 may be built into the mold so that it may be formed integral with the grip 20 during the molding process. This may also insure that during manufacture the elongate switch 22 is positioned directly under the raised portion 21 for optimum performance.

The hand grip 20 may be designed and dimensioned so that it fits tightly and securely around the handlebar yet may be just sufficiently rotatable to enable the operator to rotate it until the raised portion 21, which should be directly under the fingers, may be at the proper orientation to suit the operator's driving and gripping preference. Everyone who drives a motorcycle or other similarly operated vehicle has his or her own preferred way of gripping the handlebar. The ability to rotate the hand grip 20 as needed may enable each operator to have the raised portion 21, and with it the elongate switch 22, at exactly the right place for his or her gripping preference. Normal gripping pressure over the hand grip will not actuate the horn. The raised portion 21 must be intentionally squeezed to accomplish this.

The elongate switch 22 preferred for use in the present invention may require a pressure of 10 pounds which may be exerted at any point along the full length of the grip 20 as long as it is concentrated on the raised portion 21. When specifically applied against the raised portion the pressure may be directly over the elongate switch 22 and sufficient to actuate the horn. Typically, the elongate switch 22 may be 4 inches (10.2 cm) in length and ½ inch (1.3 cm) wide, though other dimensions may be acceptable. Since the grip 20 can be rotated as needed to insure that the raised portion 21 is always positioned under the fingers of the operator, the fingers will always be in the correct position to actuate the horn. This may enable the operator to grasp the grip 20 securely without actuating the horn, and then squeeze with slightly more pressure on the raised portion 21 when it is necessary to actuate the horn. The positioning of the hand and fingers may remain the same.

There may be two leads 23 from the elongate switch 22 extending outwardly from the inside end of the wall of the hand grip 20. The leads 23 may terminate with dual-sided connectors 24 adapted, on one side, to receive a male connector and on the other side to coact with a female connector. See FIGS. 2 and 3.

Figure 5:
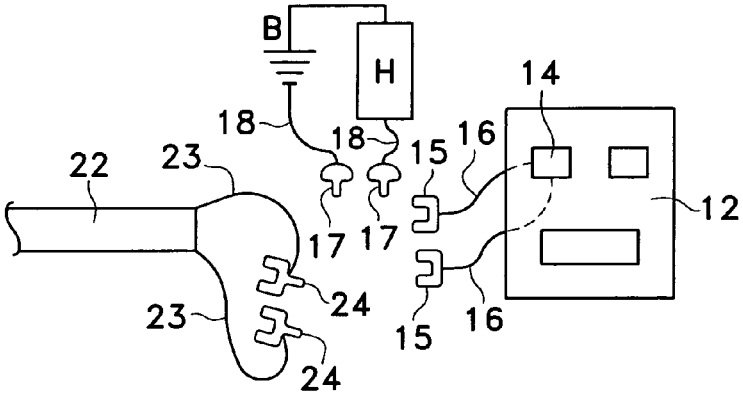
FIG. 5 is a schematic view showing the connectors from the actuator of the present invention, the horn and battery, and the console actuator, all separated.

The hand grip 20 may be easily installed on any handlebar operated vehicle by merely removing one of the hand grips 10 that came with the vehicle and sliding the new one over that same end of the handlebar 11. The electrical attachments may be just as easy to effect. The console may be opened by removing as few as two screws. The male connectors 17 at the ends of the leads 18 from the horn (H) and battery (B) may be removed from the female connectors 15 attached to the leads 16 emanating from the console actuator switch 14. (FIG. 4) The male connectors 17 from the horn and battery may thereafter be inserted into the female receptors of the dual-sided connectors 24 attached to the leads 23 from the elongate switch 21. See FIGS. 5 and 6.

Figure 7:
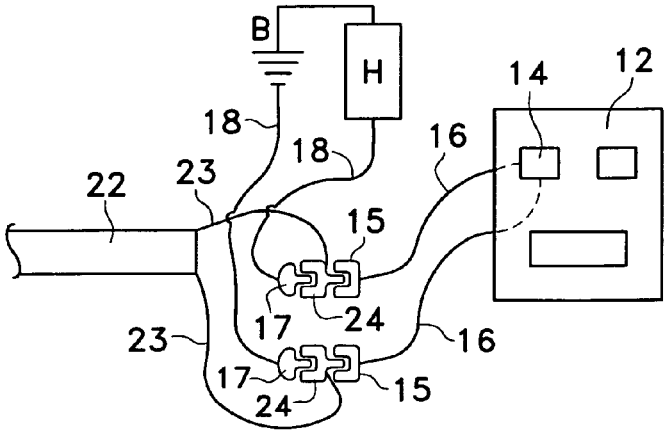
FIG. 7 is a schematic view showing all of the connectors of FIG. 5 with the connectors of the actuator of the present invention interposed between the connectors from the horn and battery and the connectors from the console actuator.

The operator of the vehicle may be very used to sounding the horn by pressing the horn actuator 14 on the console 12. Therefore, it may take a while for him or her to remember that the horn may be sounded by merely squeezing inward on the raised portion 21 of the new handlebar grip 20. For this reason the dual-sided connector 24 may be interposed between the male connectors 17 from the horn (H) and battery (B) and the female connectors 15 from the console actuator 14. As noted above, the dual-sided connectors 24 that are attached to the two leads 23 from the elongate switch 22 may have a female portion designed to accept the male connectors 17 from the horn (H) and battery (B) as well as a male portion that coacts with the female connectors 15 from the console actuator 14. See FIG. 7. This "piggy back" attachment may enable the horn to be actuated by either the actuator 14 on the console or by squeezing the raised portion 21 of the hand grip 20. The dual control may provide the operator with time to get used to being able to actuate the horn without taking his or her hand away from the handlebar, since the "old way" will still work. Additionally, should one means to actuate the horn fail, the other will accomplish the task.

Figure 6:
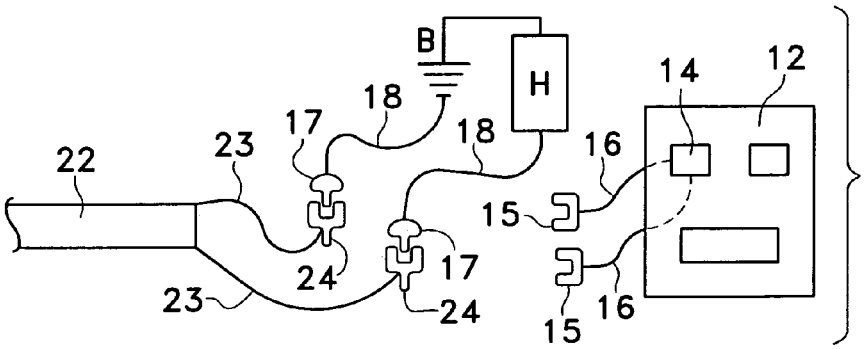
FIG. 6 is a schematic view showing all of the connectors of FIG. 5 with the actuator of the present invention connected to the horn and battery.

The operator may also choose to connect only the hand grip switch 22 to the horn and battery as shown in FIG. 6 and rely solely on the safer method of the squeezing action to actuate the horn without the need to move the hand from its normal operating orientation.

There is no doubt that being able to sound the horn without removing the hand from the handlebar, or even moving it to another location along the hand grip, and also not having to take the eyes off the road, will be an added safety factor to driving handlebar operated vehicles.

While one embodiment of the present invention has been illustrated and described in detail, it is to be understood that this invention is not limited thereto and may be otherwise practiced within the scope of the following claims.

I claim:

1. A method of installing a safety hand grip containing a first horn actuator on a handlebar operated vehicle having original hand grips on each end of a rigid handlebar, a horn, a battery, and a second horn actuator disposed on a console as part of the vehicle, said method comprising the steps of:

obtaining the safety hand grip containing the first horn actuator which comprises a resilient cylinder dimensioned to be accepted over the end portion of the rigid handlebar, an elongate switch in the form of a strip substantially the length of the cylinder and embedded longitudinally within the wall of the cylinder, a switch locator in the form of a longitudinal raised portion integral with the outside of the wall of said cylinder, said raised portion being substantially the length of the cylinder and disposed directly over said elongate switch to concentrate a force exerted by the fingers of the operator on the elongate switch, and two leads, each connected at one end to the elongate switch and the other end to an electrical connector, each of said electrical connectors being dual sided to accept two connectors, and said cylinder being sufficiently rotatable on the handlebar to enable the operator to rotate said cylinder so that the raised portion is positioned under the operator's fingers to accommodate the operator's gripping preference and so the elongate switch is always positioned for actuation of the horn by the exertion of force from the fingers of the operator on the raised portion;

removing the original hand grip from one end of the rigid handlebar;

replacing the original hand grip with the safety hand grip on the end of the rigid the handlebar;

rotating the safety hand grip so the raised portion is positioned according to the gripping preference of the operator;

opening the console;

disconnecting horn and battery connectors from the second horn actuator;

interposing the dual sided connectors from the elongate switch between the connectors from the horn and battery and the connectors from the second horn actuator; and closing the console;

whereby the horn can be actuated using the first horn actuator by exerting a force on the raised portion of the safety hand grip and also by using the second horn actuator on the console.

* * * * *